US005709035A

United States Patent [19]

Wilhelm

[11] Patent Number: 5,709,035

[45] Date of Patent: Jan. 20, 1998

[54] COUNTER FLOW COOLER

[75] Inventor: Donald M. Wilhelm, Merrimack, N.H.

[73] Assignee: California Pellet Mill Company, Nashua, N.H.

[21] Appl. No.: 681,257

[22] Filed: Jul. 22, 1996

Related U.S. Application Data

[60] Provisional application No. 60/001,339, Jul. 24, 1995.

[51] Int. Cl.[6] ..... F26B 17/12

[52] U.S. Cl. ..... 34/167; 34/173; 34/182; 34/241

[58] Field of Search ..... 34/394, 60, 66, 34/68, 167, 168, 169, 173, 174, 180, 182, 205, 214, 241; 62/378; 432/80

[56] References Cited

U.S. PATENT DOCUMENTS

| | | | |
|---|---|---|---|
| 2,386,670 | 10/1945 | Evans | 34/167 |
| 2,388,399 | 11/1945 | Forster et al. | 263/8 |
| 3,052,988 | 9/1962 | Knaust | 34/174 X |
| 4,242,806 | 1/1981 | McClaren | 34/13 |
| 4,338,161 | 7/1982 | Weber et al. | 202/228 |
| 4,423,557 | 1/1984 | Westelaken | 34/174 X |
| 4,619,606 | 10/1986 | Numberger | 432/99 |
| 4,683,665 | 8/1987 | Geelen | 34/65 |
| 5,228,207 | 7/1993 | Michel et al. | 34/12 |
| 5,522,152 | 6/1996 | Wollsey | 34/168 |
| 5,544,423 | 8/1996 | Westelaken | 34/174 |

*Primary Examiner*—Henry A. Bennett
*Assistant Examiner*—Steve Gravini
*Attorney, Agent, or Firm*—Nixon & Vanderhye

[57] ABSTRACT

A counter flow cooler in which feed material is fed into the top inlet of the cooler and dispersed into a plurality of cooling chambers. At the bottom of each cooling chamber is a discharge grid which will discharge feed material uniformly over the area of the cooling chamber. The discharge rate of this discharge grid can be adjusted to the desired throughput of the cooler. Air is drawn through the bottom of the discharge grid and passes up through the feed material in a counter flow manner. That is, while the product is passing down through the cooler, the air is passing up through the feed material, carrying away heat and possibly. A feed controller is used to selectively direct feed material into the plurality of cooling chambers. When a second batch of feed material is to be introduced into the cooler, feed material to the first cooling chamber is stopped and all the feed material is directed into the second cooling chamber. When the first cooling chamber is empty, its discharge is closed and the new feed material is directed into the first cooling chamber and feed material to the second cooling chamber is stopped. When the second cooling chamber is empty, the new feed material can be directed into the second cooling chamber and discharge of the new feed material from the first cooling chamber can begin.

16 Claims, 2 Drawing Sheets

COUNTER FLOW COOLER

This application claims the benefit of co-pending provisional application, Ser. No. 60/001,339, filed Jul. 24, 1995.

BACKGROUND OF THE INVENTION

This invention relates generally to counter flow coolers and more particularly to counter flow pellet coolers for continuous operation during product switch over.

At the end of many thermal processes handling feed or feed-stuffs, there is a cooling process. This cooling process generally involves holding the heated product for a period while subjecting it to a heat transfer media. Though the cooling process can be a continuous process, the product is often created in batches. Between batches the system must be operated in a manner that will prevent the product from the batches mixing. If the coolers are of the type where a gas is passed through the product as a cooling media, it is also necessary to prevent any dust particles that may become entrained in the gas passing through one product from getting mixed with the other product.

Traditionally to achieve the separation of batches, it is necessary to allow product to enter the cooler until the end of the run occurs. Then the cooler must continue to run until it becomes empty. The flow of the product of the subsequent run can not begin to flow into the cooler until it is empty. This requires that the upstream process be stopped. It would not be possible to accumulate the hot product in a temporary surge bin, as the extra long exposure to high temperatures by the product may cause the material properties to change.

Thus by the traditional methods, the operating thermal process must be interrupted. The starting and stopping of an otherwise continuous process complicates process control. The down time reduces the productivity of the process equipment and increases operating costs.

The foregoing illustrates limitations known to exist in present coolers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a counter flow cooler comprising: a housing having a plurality of cooling chambers therein; a distribution means for selectively feeding feed material into at least one of the cooling chambers.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
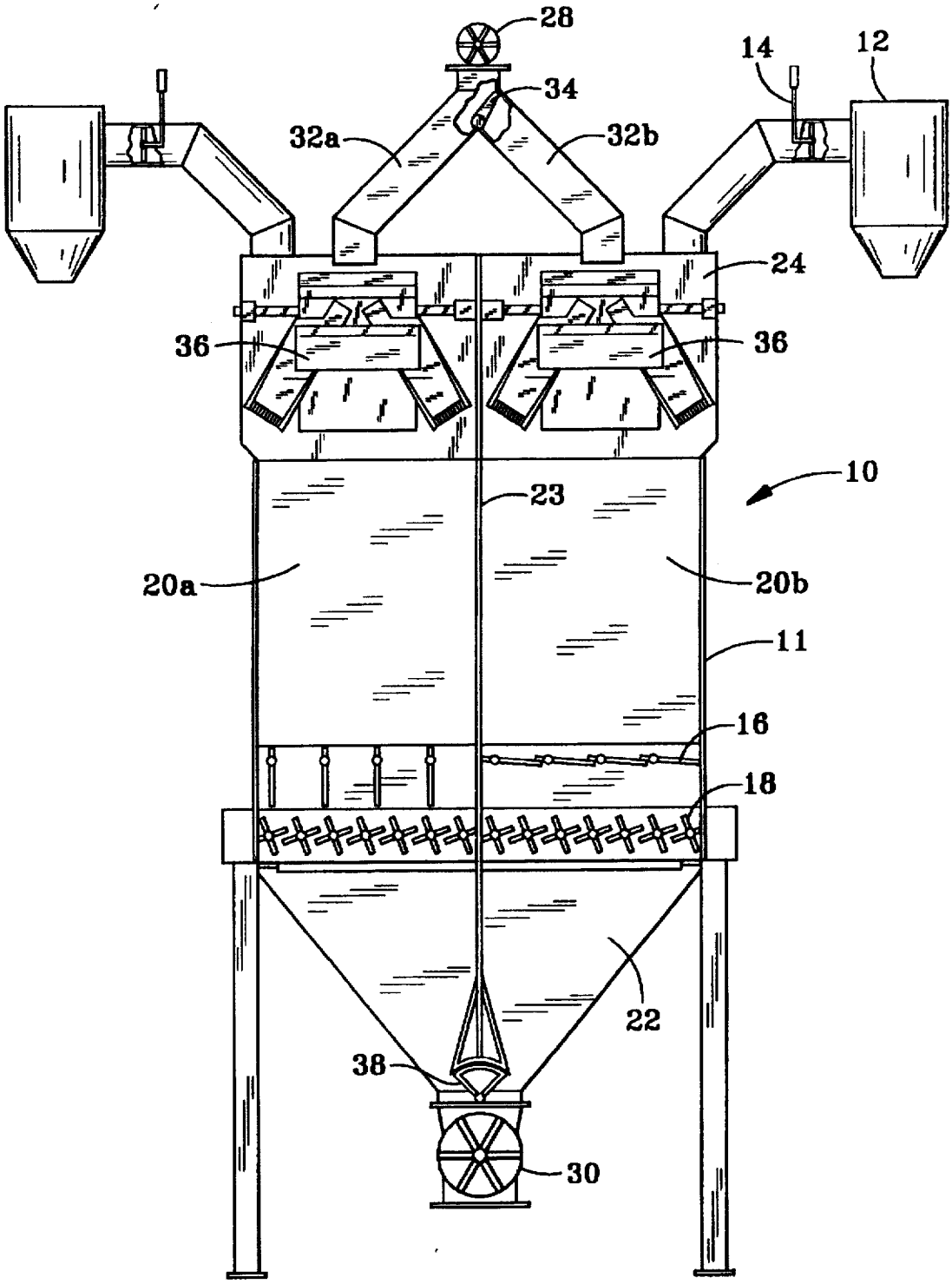
FIG. 1 is cross-sectional view of a counter flow cooler with a plurality of internal cooling chambers.

FIG. 1 shows a counter flow cooler 10 which includes a housing 11 having a plurality of cooling chambers 20*a*, 20*b*, within the housing 11. Although two cooling chambers 20*a*, 20*b* are shown in FIG. 1, three, four or more cooling chambers can be within the housing. At the upper end of the housing 11 is a feed inlet housing 24. Within the housing 11 is an internal divider 23 which divides the housing 11 into the cooling chambers 20*a*, 20*b*. In the preferred embodiment shown in FIG. 1, the internal divider 23 extends into the feed inlet housing 24. Connected to the feed inlet housing 24 are a plurality of air handling systems 12. There is an air handling system 12 associated with each cooling chamber. In the conduit connecting an air handling system 12 to the feed inlet housing 24 is an air flow controller 14. The air handling system 12 draws air into the cooler housing, into the outlet end of the cooling chamber and through any feed material in the cooling chamber. Any fines from the feed material collected in air handling system 12 are returned to a discharge hopper 22 located below the cooler housing 11.

Connected to the top of the feed inlet housing 24 are a plurality of feed conduits 32*a*, 32*b*. These conduits 32*a*, 32*b* connect at one end to an inlet air lock 28 (which can be any type of air lock typically used in the industry, including a rotary air lock) and at the other end to feed inlet housing 24. There is a feed conduit associated with each cooling chamber. Contained in the common connection of the feed conduits to the inlet air lock 28 is a distribution means 34.

Preferably, the distribution means 34 is a flap gate or a screw conveyor with a split screw. During the switch over from one feed material to the other feed material, it is preferred to seal one cooling chamber 20*a* from the other cooling chamber 20*b* to prevent cross product contamination. A flap gate, as distribution means 34, in combination with the internal divider 23 extending up into and separating one cooling chamber from the other, also functions as a sealing means. If a screw conveyor or other flow spitting device is used, a separate sealing means should be provided to seal one cooling chamber from the other. For example, separate gate valves in each conduit could be used.

An operator (not shown) is provided to operate the flap gate 34. The operator can be used to adjust the speed and dwell of the flap gate 34 to direct feed material to one cooling chamber or the other or to more evenly distribute flow to the cooling chambers. For example, if one cooling chamber 20*a* were emptying faster than the other cooling chamber 20*b*, perhaps due to a greater concentration of fines, the operator can pause the flap gate 34 at the end of a stroke to direct more feed material to that cooling chamber 20*a*.

Figure 2:
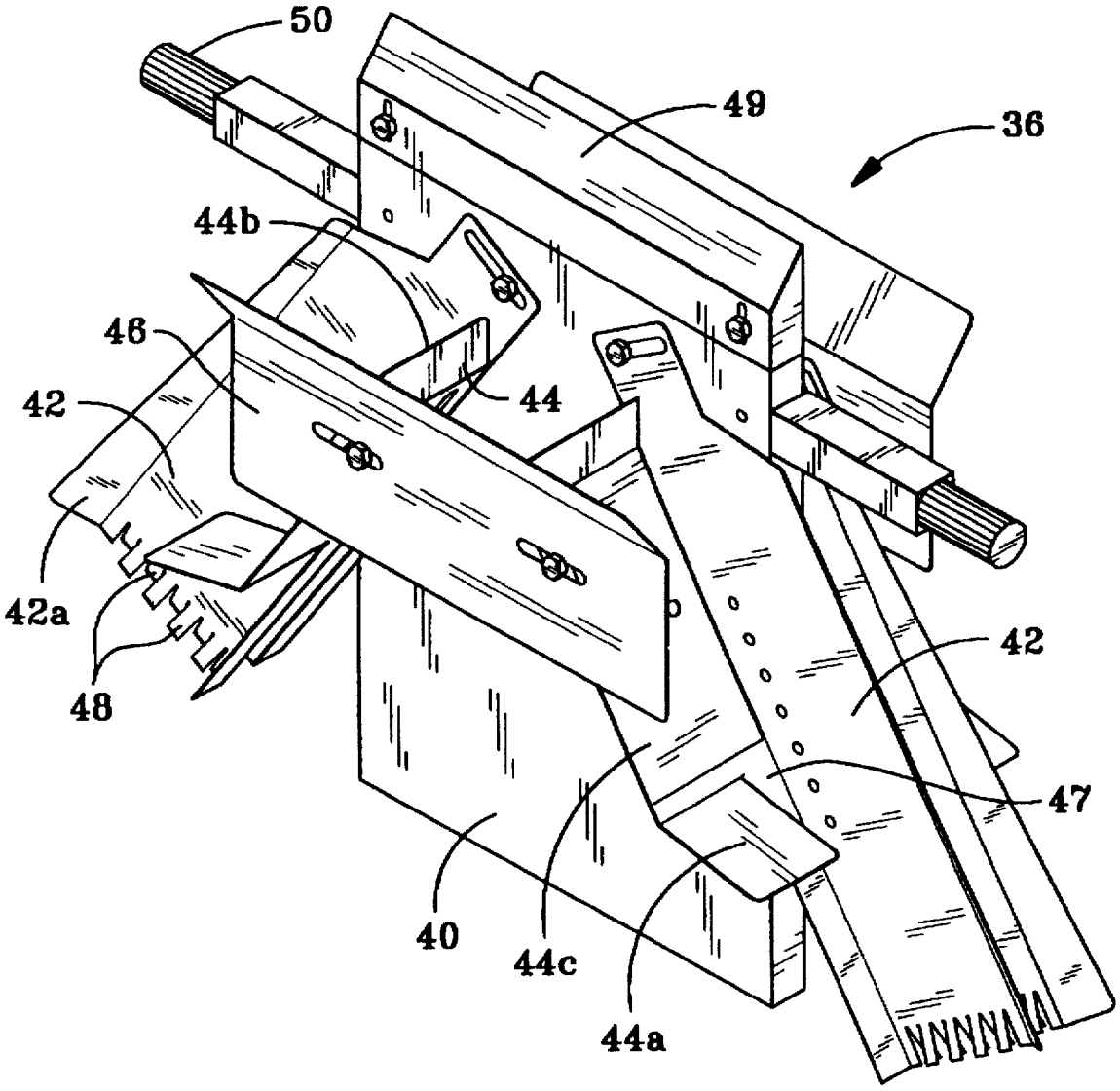
FIG. 2 is a perspective view of a pendular feed distributor for use with the counter flow cooler shown in FIG. 1.

The feed inlet housing 24 contains feed distribution means 36 associated with each cooling chamber. Preferably the feed distribution means consists of a pendular, swinging, paddle-like spreader as shown in FIG. 2. A spreading plate 40 is rotated about a shaft 50 approximately 45 degrees in each direction from vertical in a reciprocating or pendular fashion. In the event the feed material has a trajectory which makes the feed material contact the spreading plate 40 off center or at an angle, an angled divider cap 49 can be used to compensate for this so that in the vertical the spreader 36 intersects the feed material, dividing it into two even streams.

When the spreader 36 is in the ±20 degree position, material flow is forced onto the spreading plate 40 by a cross plate 46. Feed material is then divided into three streams by two adjustment plates 44. By moving these plates upward or downward along a side wing 42, a plate edge 44*b* moves upward and inward or downward and outward until the flow is divided into three streams of approximately 35% to each side and 30% to the middle. The feed flow to each side flows along a side wing surface 44*c* normal to the spreading plate 40 until it is deflected by a side wing deflector 44*a*. The feed material flow in the middle continues down the spreading plate 40 and spreads slightly outward. A flow deflector 42*a* is provided on the edge of the side wing 42 opposite the edge to which the adjustment plate 44 is attached. The flow deflector 42*a* is used to deflect any feed material which may otherwise flow over the upper (or outer) edge of the side wing 42.

When the spreader 36 is in the ±20 to 45 degree position, feed material is divided into three flow streams by the two adjustment plates 44. The feed material flows along the side wing 42 and passes under the side wing deflector 44*a* by way of a side wing bypass 47 and is then spread out by a series of side wing randomizing tabs 48. The feed material flow in the middle continues down the spreading plate 40 and spreads slightly outward.

As an alternative to the flap gate 34 to distribute feed among the cooling chambers, the pendular spreader 36 shown in FIG. 2 could be provided in the feed inlet housing 24. In this case, a separate sealing means can be provided to seal one cooling chamber from another.

At the outlet of each cooling chamber, a discharge grid 18 is provided to control the rate of discharge of feed material from the cooling chambers. Preferably, a sliding grate discharge grid, such as the type described in U.S. Pat. No. 4,683,665, is used. Preferably, the discharge grid 18 of each cooling section is independently operated. If a single discharge grid is used for the entire cooler 10, a separate shut off gate 16 is provided for each cooling chamber. Typically, cooling air enters the cooler through the discharge grid 18.

Discharge hopper 22, located below the cooling chambers, is split into internal hoppers, one for each cooling chamber. At the outlet of these internal hoppers is a discharge hopper flow controller 38. As shown in FIG. 1, this discharge hopper flow controller 38 is a quarter drum pivotally mounted. When the quarter drum is in the mid-position, as shown in FIG. 1, flow from both internal hoppers is allowed, as illustrated by the arrows. If the quarter drum is pivoted to the left or the right, it will stop the flow of feed material from the left or right internal hopper, respectively. The addition of discharge flow controller 38 permits the discharge hopper 22 to be used a surge container during feed material batch switch over. The discharge hopper 22 also helps to prevent fines which pass through grid 18 from entering into air lock 30. Located below the discharge hopper 22 is an optional outlet air lock 30 for controlling the rate of discharge from the discharge hopper 22.

SEQUENCE OF OPERATIONS

1. Turn on the air handling systems 12. Adjust the air flow controls 14 to the desired level.
2. Open the discharge grid 18.
3. Start the pendular spreaders 36.
4. Start the flap gate 34 to swing over full arc so that it swings equally over the plurality of conduits 32.
5. Start the inlet air lock 28.
6. Start the feed material flow into the inlet air lock 28.
7. Allow the feed material to accumulate on the discharge grid 18, which is not currently operating. Feed material will start to accumulate in the cooling chambers 20*a*, 20*b*. The air flow controls 14 will operate as needed to maintain the desired air flow through the feed material bed.
8. When the feed material has accumulated to the desired level, start the discharge grid 18. Feed material will pass through the discharge hopper 22 and is discharged from the cooler 10. The discharge rate from the discharge grid 18 is adjusted so that the desired feed material bed depth is maintained.
9. A signal is received that the current feed material is approaching the end of its run.
10. The flap gate 34 is switched so that feed material is discharged only into conduit 32*b* and cooling chamber 20*b*.
11. The discharge rate of the discharge grid 18 is increased so that the feed material in cooling chamber 20*b* does not over fill the cooling chamber. This discharge rate can be controlled by a level detector (not shown).
12. The feed material level in cooling chamber 20*a* drops quickly because no feed material is entering the cooling chamber because the flap gate 34 is switched to fill only cooling chamber 20*b*. As the feed material level drops, the air flow control 14 operates to compensate from the loss of air resistance through the feed material bed.
13. When cooling chamber 20*a* is empty, a signal is sent to the upstream process indicating that a second new feed material can be processed.
14. A signal is generated by the upstream process that the last of the first feed material has entered the cooler.
15. The discharge grid 18 for cooling chamber 20*a* is closed. The flap gate 34 is switched to admit the new second feed material into cooling chamber 20*a*. The second feed material begins to accumulate on the discharge grid in cooling chamber 20*a*.
16. When cooling chamber 20*b* is empty of the first feed material, the discharge grid for cooling chamber 20*b* is closed. The flap gate 34 is switched to admit the second feed material into cooling chamber 20*b*.
17. Second feed material now accumulates in cooling chamber 20*b*. While the level is lower in cooling chamber 20*b* than in cooling chamber 20*a* a differential load will exist on the internal divider 23. The difference in the levels can be detected by measuring the differential load on the internal divider 23 or can be measured by level detectors in both cooling chambers.
18. When the level of second feed material in cooling chamber 20*b* approaches the level in cooling chamber 20*a*, the flap gate 34 is switched to fill both cooling chambers.
19. If the cooling chambers are not being filled at the same, the swing (or dwell at the end of a stroke) of the flap gate 34 can be adjusted to deposit more feed material into the lower of the two cooling chambers.
20. When the level of the second feed material in the cooling chambers reaches a desired level, the discharge grids 18 are operated to start the discharge of feed material.

In addition to being used for switch over of feed material types while remaining in operation, the cooler shown in FIG. 1 can also be used as a two capacity cooler. For "full" capacity, both cooling chambers are used with feed material being admitted to both cooling chambers. For "reduced" capacity, where a smaller of batch of feed material is being processes, only one cooling chamber is used. The flap gate 34 is adjusted to direct feed material to only one cooling chamber and the discharge grid 18 for the idle cooling chamber can be closed. This permits the creation of proper bed depths when the cooler is operating at reduced capacity, thus maintaining proper cooler performance.

Having described the invention, what is claimed is:

1. A counterflow cooler comprising:

a housing having a plurality of cooling chambers therein;

a distribution means for selectively feeding feed material into at least one of the cooling chambers;

each cooling chamber having an airflow means for passing air through the cooling chamber; and a sealing means for sealing the flow of air in one cooling chamber from the other cooling chamber.

2. A counter flow cooler comprising:

a housing divided into a plurality of cooling chambers, each cooling chamber having an inlet, an outlet and an air flow means for passing air through the cooling chamber;

a distribution means for selectively feeding a feed material into at least one of the cooling chamber inlets;

a sealing means for sealing the flow of air in one cooling chamber from the other cooling chambers; and a discharge means for controlling the rate of discharge of feed material from the outlets of the cooling chambers.

3. The counter flow cooler according to claim 2 wherein the discharge means includes a means for stopping the flow of feed material from the cooling chamber outlets.

4. The counter flow cooler according to claim 2 wherein the discharge means comprises a plurality of separately operable cooling chamber discharge means for individually controlling the flow of feed material from the outlets of the cooling chambers.

5. The counter flow cooler according to claim 2 wherein the discharge means comprises a single discharge grid means for simultaneously controlling the rate of discharge of feed material from all the cooling chambers.

6. The counter flow cooler according to claim 5, further comprising:

a plurality of individually operable shutoff means for stopping the flow of feed material from the cooling chamber outlets, there being a shutoff means associated with each cooling chamber.

7. The counter flow cooler according to claim 2, further comprising:

a discharge hopper receiving the feed material discharged from the outlets of the cooling chambers.

8. The counter flow cooler according to claim 7 wherein the discharge hopper is divided into a plurality of chambers, each chamber having an outlet, there being a single chamber associated with and in flow communication with each cooling chamber outlet.

9. The counter flow cooler according to claim 8, further comprising a discharge flow control means for selectively controlling the flow rate from at least one discharge hopper.

10. The counter flow cooler according to claim 7, further comprising:

an outlet air lock means for sealing an outlet end of the discharge hopper.

11. The counter flow cooler according to claim 2, further comprising:

an inlet air lock means for atmospherically sealing an inlet end of the housing.

12. A counter flow cooler comprising:

a housing being divided into a plurality of cooling chambers, each cooling chamber having an inlet, an outlet and an air flow means for passing air through the cooling chamber;

a distribution means for selectively feeding a feed material into at least one of the cooling chamber inlets, the distribution means comprising a pivotally mounted pendular spreader including a planar paddle like portion extending from a horizontal axis about which the pendular spreader pivots;

a sealing means for sealing the flow of air in one cooling chamber from the other cooling chambers; and a discharge means for controlling the rate of discharge of feed material from the outlets of the cooling chambers.

13. The counter flow cooler according to claim 11 wherein the pendular spreader includes a pair of spaced apart bars on each face of the planar paddle like portion, the bars extending longitudinally from the horizontal pivot axis, the ends of the bars proximate the horizontal pivot axis being closer together than the ends of the bars distal the horizontal pivot axis.

14. The counter flow cooler according to claim 13 wherein there is a gap between the ends of the bars proximate the horizontal pivot axis.

15. A counter flow cooler comprising:

a housing being divided into a plurality of cooling chambers, each cooling chamber having an inlet, an outlet and an air flow means for passing air through the cooling chamber;

a distribution means for selectively feeding a feed material into at least one of the cooling chamber inlets;

a sealing means for sealing the flow of air in one cooling chamber from the other cooling chambers; and a discharge means for controlling the rate of discharge of feed material from the outlets of the cooling chambers;

the distribution means and sealing means comprising a conduit means associated with and in flow communication with each cooling chamber and a flow selection means for selectively feeding the feed material into at least one of the conduit means and for sealing one conduit means from other conduit means.

16. The counter flow cooler according to claim 15, further comprising:

a feed distribution means associated with each cooling chamber for distributing feed material about the interior of the cooling chamber.

* * * * *